United States Patent [19]

Cahuzac

[11] Patent Number: 4,555,918

[45] Date of Patent: Dec. 3, 1985

[54] UNITARY NEEDLE WITH OPENABLE EYE

[75] Inventor: Georges J. J. Cahuzac, Le Bouscat, France

[73] Assignee: Societe Nationale Industrielle et Aerospatiale, Paris, France

[21] Appl. No.: 587,402

[22] Filed: Mar. 8, 1984

Related U.S. Application Data

[63] Continuation-in-part of Ser. No. 228,925, Jan. 27, 1981, abandoned.

[30] Foreign Application Priority Data

Aug. 11, 1980 [FR] France ..... 80 17665

[51] Int. Cl.[4] ..... D03B 35/02

[52] U.S. Cl. ..... 66/119

[58] Field of Search ..... 139/431, 432; 66/119, 66/116, 120, 121, 123; 112/222, 223–227

[56] References Cited

U.S. PATENT DOCUMENTS

| | | | |
|---|---|---|---|
| 2,202,945 | 6/1940 | Broberg | 66/119 |
| 2,403,961 | 7/1946 | Amidon | 66/116 |
| 2,626,514 | 1/1953 | Schoenster | 66/119 |
| 3,258,938 | 6/1966 | Hofmann | 66/119 |
| 4,007,609 | 2/1977 | Zorini | 66/116 |
| 4,183,232 | 1/1980 | Banos et al. . | |
| 4,393,669 | 7/1983 | Cahuzac . | |

*Primary Examiner*—Henry S. Jaudon

*Attorney, Agent, or Firm*—Murray Schaffer

[57] ABSTRACT

A needle for interlacing yarns, strands or the like in a multi-directional woven structure composed of a shank bent to form an elastic blade. The end of the blade is normally resiliently applied against the shank, so as to form the eye of the needle which is opened by moving the blade away from the shank by means of an opener. The yarn is thus inserted and the eye is allowed to close while the needle is moved.

5 Claims, 11 Drawing Figures

1
4'
4"
4
6
7
11
14
18

UNITARY NEEDLE WITH OPENABLE EYE

RELATED APPLICATION

This is a continuation-in-part of copending application Ser. No. 228,925 filed Jan. 27, 1981 entitled Needle with Opening Eye now abandoned.

BACKGROUND OF THE INVENTION

The present invention relates to a needle intended for interlacing yarns, strands or flexible cords into an already known structure composed of a shank which is bent at its end to form a blade, defining an eye.

The needle of this type finds application particularly in the manufacture of reinforced multi-directional woven or knitted structures of revolution. Such reinforced structures are used after impregnation with an appropriate binding agent, to make structural assemblies of composite material which may undergo very severe mechanical and thermal stress, for example nozzles, radioelectric antenna, windows for space shuttles, turbine vanes, nose cones of re-entry bodies, armour-plating, etc.

Numerous process for weaving structures of revolution exist, and particularly processes for three-dimensional weaving, in which the circumferential and longitudinal yarns are connected by radial yarns. The needles usually used for making this connection are so-called sewing and/or knitting needles. The former, such as used in French Patent Application No. 76 02943 of Feb. 3, 1976, comprise a closed eye. They carry a stitching yarn knotted with a second yarn past, via a shuttle, in a loop of the first yarn. The latter are latch needles such as described in French Pat. No. 75 20117 of June 26, 1975 and in U.S. Pat. No. 4,149,477.

A latch needle engages, with the latch open, in the structure being woven, hooks a yarn and returns it through the structure, latch closed, the connection between yarns being made by a chain stitch.

In the case of making reinforcements of any form on a woven structure mode on metal rods, the conventional latch needle as used in the above-mentioned patents comprises a head which is too large to be able to perform its function. Due to its constitution, the risks of untimely hooking of the yarns of the woven structure are multiplied not only in case of false maneuver, but also during normal use. Such a risk is run, for example, when the needle enters in the woven fabric, then moves back before its head has emerged on the opposite side. Furthermore, it is sometimes difficult to grip a large number of yarns or a yarn and/or a large strand of yarns with a latch needle, due to its size, insofar as the gripped yarns tend to escape before the latch closes again. If a large number of yarns is to be gripped, it is necessary to use a latch needle having a large-size point, but this leads to a certain fragility in this zone. On the other hand, in woven reinforcements adapted to withstand considerable mechanical and thermal stress, the textile structure most frequently used is a carbon filament or strand, which is very fragile and therefore easily damaged by the mobile latch.

SUMMARY OF THE INVENTION

To overcome the drawbacks of known needles, it is an object of the present invention to provide a needle, particularly adapted for making reinforcements in any form of multidirectional weaving. This needle, which is of the type indicated hereinabove, is characterized in that the end part of its shank is flattened on one side and is bent to form an elastic blade of which the flattened free end is normally applied in abutment against the shank to form the eye of the needle. The eye formed between the blade and the shank being normally closed, is openable by moving the end of the blade away from the shank by the elastic deformation of the blade under the action of an opener to allow yarns to be introduced in the eye thus opened.

A needle with an openable eye according to the present invention may be used in place of a latch needle, without having the drawbacks thereof. This comes from the fact that the eye of the needle is normally closed. This permits the needle to move in this state through a woven structure, in one direction as well as in the opposite direction, without any risk of hooking the yarns of the woven structure. The eye is opened by the opener only at the moment and at the spot where yarns are to be gripped by the needle, to be drawn for example through the woven structure, whilst a latch needle must pass through the woven structure with the latch open to seek yarns to be gripped, this being without possibility of moving back if necessary.

The above-mentioned elastic blade preferably comprises, near the end of the needle shank, a thin portion forming a hinge and facilitating its deformations when the eye is opened and closed.

The outer end of the blade is advantageously bevelled to ensure perfect slide, without risk of untimely hooking, of the needle having gripped yarns and moving back through a woven structure, drawing the yarns with it.

As to the extreme outer end of the shank forming the head of the needle, it is preferably shaped as a point so as to facilitate penetration of the needle in a woven structure, to grip yarns. The end of the shank may also offer a disk-shaped cavity in which engages the end of a metal rod which, previously incorporated in the woven structure, must be chased by the needle.

In conclusion, a needle with opening eye according to the invention avoids untimely hooking of the weaving material both during normal use and in the case of false maneuver. It enables a large number of yarns or a yarn of large diameter to be gripped and a very fragile yarn to be used without damaging it. It is easy to manufacture and its constitution is such that it may have as fine a head as is desired.

The invention will be more readily understood on reading the following description with reference to the accompanying drawings.

DESCRIPTION OF THE INVENTION

Figure 1:
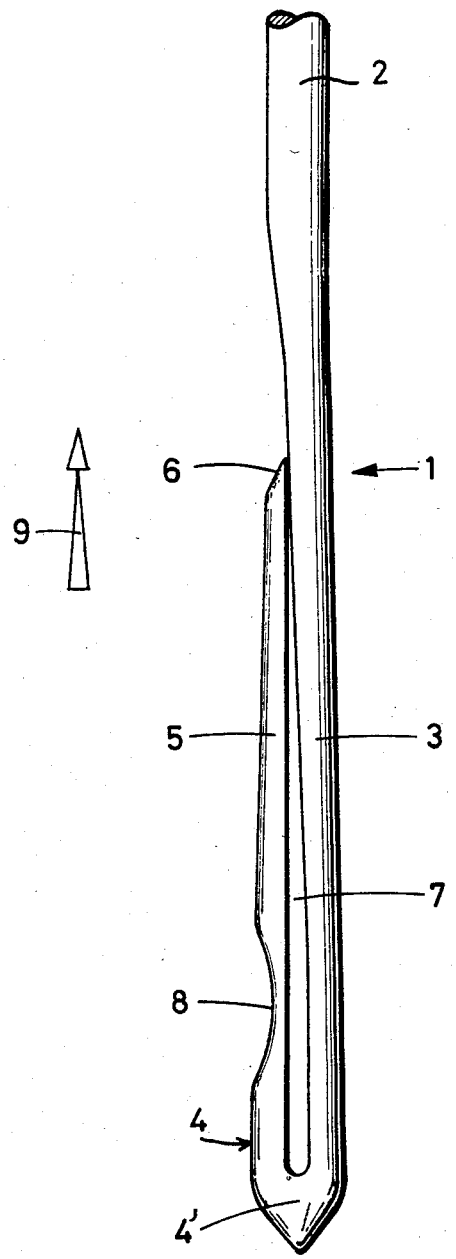
FIG. 1 shows in elevation a needle with opening eye according to the invention, only the zone of the needle's eye being shown.
Figure 3:
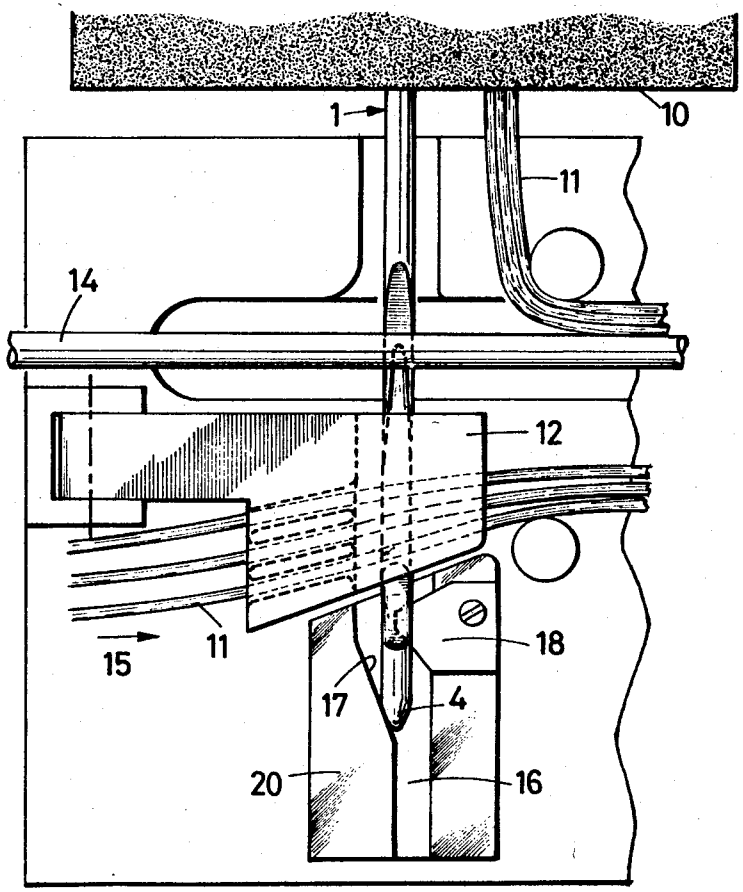
FIGS. 2 to 5 show part of a machine using the needle of FIG. 1, in various successive phases of operation.

Referring now to the drawings, FIG. 1 shows an embodiment of a needle with opening eye according to the invention. This needle 1 comprises unitary one piece rectilinear shank 2 whose section is circular in the present example, but may be of any other form. The shank 2 may be of any length; it may be very long and reach one meter or more. This shank is provided in its terminal zone a thinner part 3 which is bent, beyond the head 4 of the needle, to form a flexible blade 5 abutting elastically by its end 6 on the shank 2, where part 3 of said shank begins. The blade 5 and part 3 of the shank 2 are formed with flat land faces lying in opposition to each other, and define a space 7 which constitutes the eye of the needle, which is normally closed. The tip end 6 of the blade 5 abuts against the land surface of the thinner part 3 thus providing a one piece unarticulated needle which is substantially straight, though the eye, has a generally smooth rounded exterior surface and is not substantially larger, in diameter, at the eye than at the shank. Further, the outer surface of the tip end 6 of the blade 5 is bevelled, as shown, so that the needle 1 can pass downwardly through a woven structure in the direction of arrow 9 without risk of untimely hooking of the yarns of said structure.

Using an opener of which an embodiment will be described hereinafter, it is possible to easily move the blade 5 away from the part 3 of the shank 2, so as to open the eye 7 at the level of the end 6 of said blade. This opening involves an elastic deformation of the blade 5, which is facilitated by the presence of a thin zone 8 which is formed not far from the head 4 of the needle 1 and which acts as a hinge. With the eye 7 of the needle being open, yarns may penetrate therein and be housed therein to be taken, after the eye has been closed, through a woven structure by the needle 1 moving in the direction of arrow 9. To allow the needle to return easily through the woven structure by an opposite movement, its head 4 has been shaped as a point 4', as shown.

Figure 2:
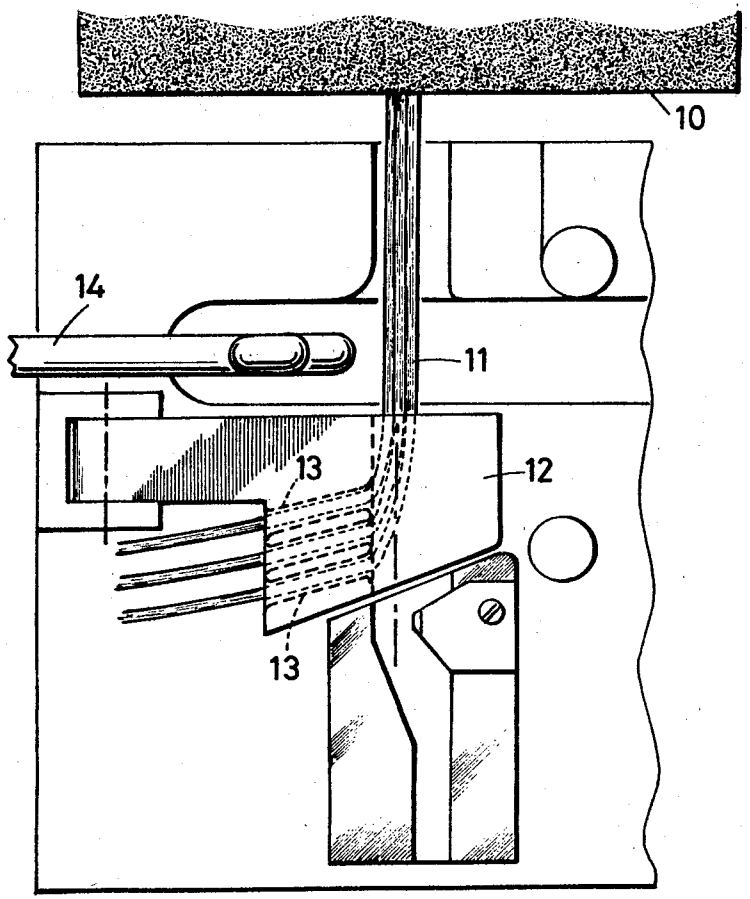
Figure 5:
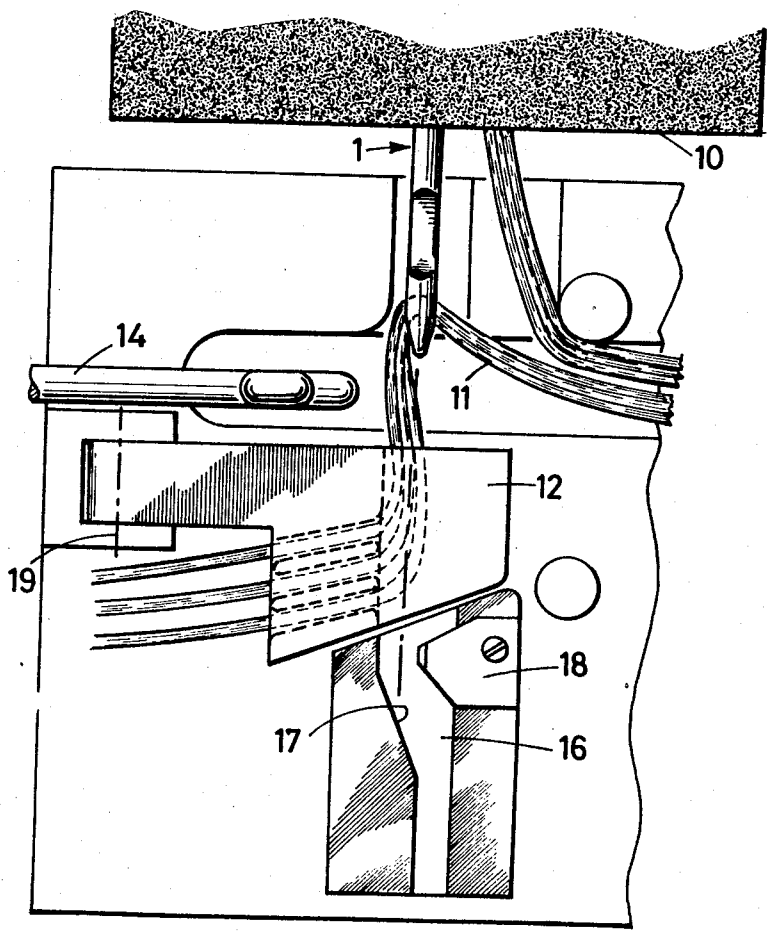
Figure 4:
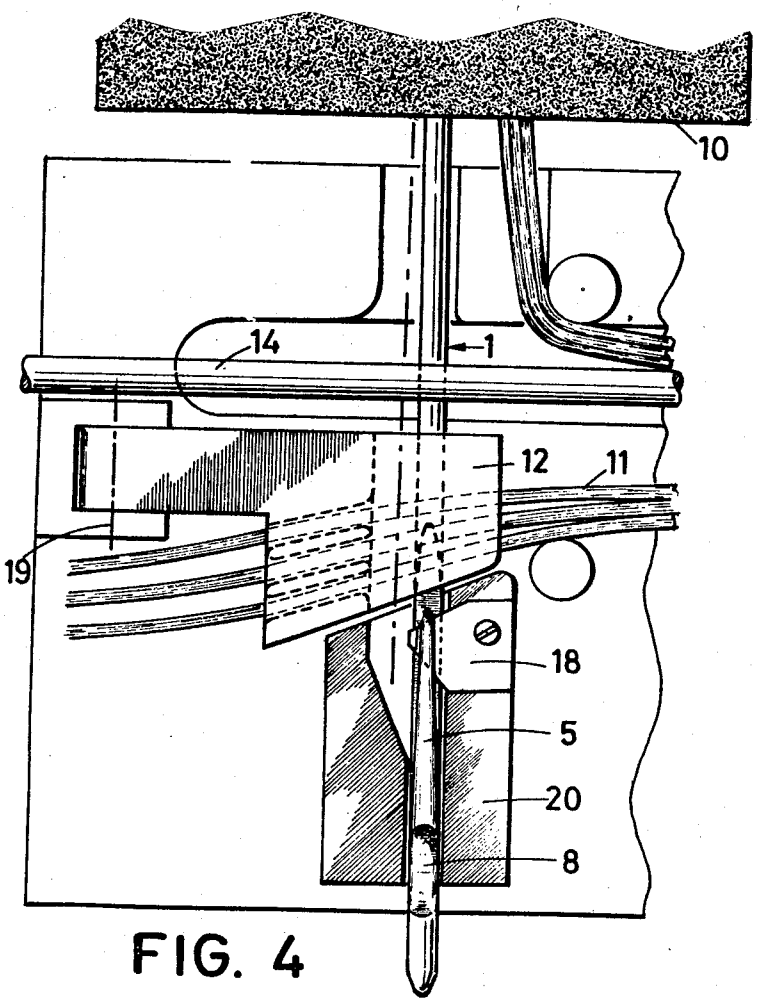

FIGS. 2 to 6 illustrate an example of use of a needle according to the invention. FIG. 2 shows part of a machine for making a woven structure 10 through which a strand of yarns 11 is to be passed repeatedly in vertical direction. These yarns, three in number in the present example, are guided on arrival by a presenting device 12 offering three guide conduits 13. The strand of yarns 11, rising vertically on leaving the conduits 13 of the presenting device, is periodically subjected to the action of a horizontal push member 14 which drives the yarns towards the right (FIG. 3) with formation of a loop of suitable length and unwinding of the yarns, through the presenting device 12, in the direction of arrow 15 from a supply reserve (not shown).

A needle 1, formed in accordance with the needle described hereinabove, then descends through the woven structure 10 and passes behind the push member 14 and the yarns 11 leaving the presenting device 12, its eye 7 being closed. Its head 4 penetrates in a passage 16 made in a fixed piece 20, tapering due to the presence of an oblique wall 17 which the head 4 of the needle encounters and which pushes it slightly towards the right. This movement causes the penetration of a fixed knife 18 in the eye 7 of the needle 1 (FIGS. 3 and 6*a*), this knife forming, with the piece 20 and its passage 16, the opener mentioned hereinabove. The needle continues to descend (FIGS. 4 and 6*b*) and the part 3 of the shank arrives entirely below the yarns 11, whilst the eye 7 opens under the action of the knife 18.

Figures 6A, 6B, 6C, 6D, 6E, 7:
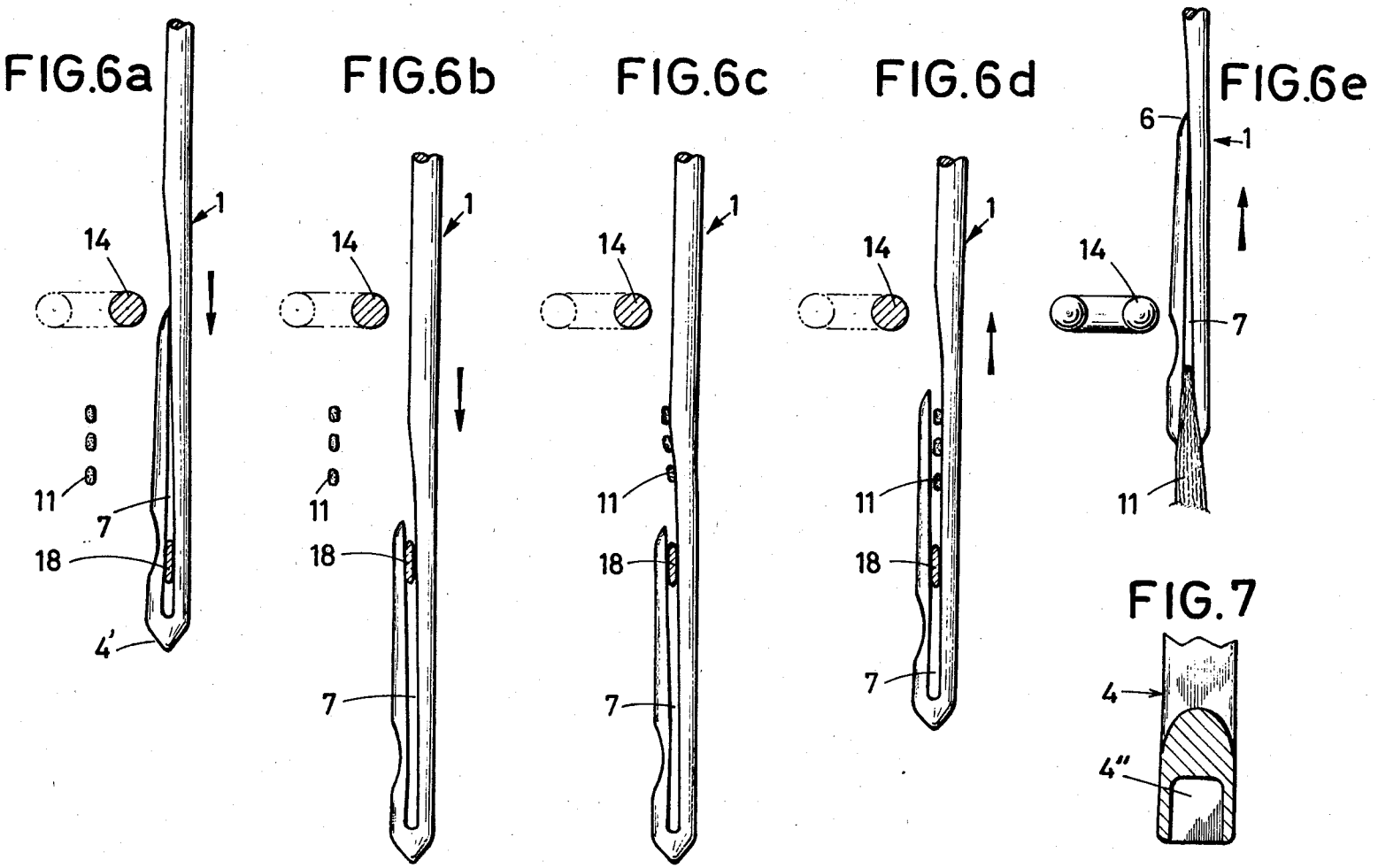
FIGS. 6*a* to 6*e* schematically show how the needle according to the invention functions, in successive views corresponding to sections of the machine of FIGS. 3 to 5 along a plane parallel to the needle and perpendicular to the plane of the yarns manipulated thereby.
FIG. 7 shows in section, on the scale of FIG. 1, the head of a needle in a variant embodiment.

The presenting device 12, which is mounted on a vertical pivot pin 19, then pivots about this pin and applies the yarns 11 against the shank of the needle (FIG. 6*c*). The push member 14 returns towards the left; the needle then beginning to rise again, these yarns penetrate in the open eye 7 (FIGS. 6*d* and 5) and are finally gripped in the eye of the needle and drawn in the form of a loop through the woven structure 10 (with concomitant reabsorption of the loop initially formed by the push member 14). The eye 7 was previously closed again by disengagement of the knife 18 on passage of the head 4 of the needle along the oblique wall 17.

FIG. 7 shows a variant embodiment in which the head 4 of the needle 1 comprises, not a point 4', but a cavity 4'' whose shape is adapted to that of the end of the rods which the needle is possibly to push on descending through the woven structure.

What is claimed is:

1. A needle for interlacing reinforcing yarns, strands or flexible cords in a multi-directionally woven or knitted structure comprising a unitary shank, the terminal part of which is thinner than the remainder thereof, said terminal part having a flat surface on one side thereof, and being bent back on itself so that said flat surface forms a land face on the bent portion lying in opposition a land face on the unbent portion and defining therebetween an eye, the bent portion of said terminal part forming a straight flexible blade, the free end of which is normally biased into abutment with the flat land face of the unbent portion of the terminal part to normally maintain said eye closed the bent portion of said blade being reduced in thickness toward said free end forming an integral hinge facilitating elastic deformation on opening and closing of the eye for introduction and removal of yarn, strands or cords, and provide a straight smooth exterior surface in combination with the shank.

2. The needle according to claim 1, wherein the outer surface of the blade is bevelled.

3. The needle according to claim 1, wherein the outer surface of the shank forming the bend in the needle is shaped as a point.

4. The needle according to claim 1, wherein the outer surface of the end of the shank forming the unbent portion of the terminal part of the needle is provided with a recessed-shaped cavity.

5. The needle according to claim 1, wherein said blade is substantially rectilinear.

* * * * *